United States Patent [19]

Kobler

[11] Patent Number: 4,753,611

[45] Date of Patent: Jun. 28, 1988

[54] FILTERED COAXIAL ASSEMBLY

[75] Inventor: Robert J. Kobler, Harrisburg, Pa.

[73] Assignee: AMP Incorporated, Harrisburg, Pa.

[21] Appl. No.: 32,898

[22] Filed: Mar. 31, 1987

[51] Int. Cl.[4] ..... H01R 17/18

[52] U.S. Cl. ..... 439/578; 439/620; 439/936

[58] Field of Search ..... 439/620, 276, 874, 875, 439/620, 607, 608, 936, 933, 935, 578-585; 333/181, 182, 183, 184, 70, 79

[56] References Cited

U.S. PATENT DOCUMENTS

| | | | |
|---|---|---|---|
| Re. 29,258 | 6/1977 | Fritz | 333/70 S |
| 2,619,519 | 11/1952 | Marks | 439/874 |
| 3,267,396 | 8/1966 | Scott | 333/70 |
| 3,315,214 | 4/1967 | Davis | 439/578 |
| 4,099,825 | 7/1978 | Jackson | 339/177 E |
| 4,206,963 | 6/1980 | English et al. | 439/620 |
| 4,267,536 | 5/1981 | Hollyday | 439/620 |
| 4,374,605 | 2/1983 | Bratt | 439/620 |
| 4,401,355 | 8/1983 | Young | 439/620 |
| 4,674,809 | 6/1987 | Hollyday et al. | 339/92 |

OTHER PUBLICATIONS

AMP Catalog No. 4507-1, "Engineering and Purchasing Guide-Fifth Edition", p. D-3, AMP Incorporated, Harrisburg, PA.

"EMI/RFI Suppression Filters", p. 6 of catalog, Spectrum Control, Inc., Erie, PA.

Dwg. No. 1240-030-0000, "1 Line Filtered Connector", Erie Technological Products of Canada, Ltd.

"Amphenol Standard Coaxial Connectors", catalog p. 38: TRIAX Plugs, Jacks, Receptacles and Caps, Amphenol Products, Oak Brook, IL.

"Amphenol Standard Coaxial Connectors" catalog, p. 35: TWIN Receptacles, Adapters and Accessories, Amphenol Products, Oak Brook, IL.

Catalog No. 52 8160, "Kings 75-Ohm BNC Connectors", Kings Electronics Co., Inc., Tuckahoe, NY.

"Tool Crimp & Ground Filter Connectors", catalog p. 31, Trompeter Electronics, Thousand Oaks, CA.

Application Note, "Trompeter Filter Connector Cuts EMI/RFI in Digital Systems-Helps Meet FCC Spec", Trompeter Electronics, Thousand Oaks, CA.

*Primary Examiner*—David Pirlot

*Attorney, Agent, or Firm*—Katherin A. Nelson

[57] ABSTRACT

A filter sleeve (15) is soldered within a coaxial assembly (10). The outer diameter of the filter sleeve (15) is soldered to an outer member (12) comprising a ground shell (2), and the inner diameter of the filter sleeve (15) is soldered to an inner member comprising a contact terminal (11). The contact terminal (11), filter sleeve (15) and ground shell (2) are arranged concentrically with respect to each other. With this structure, excellent mechanical rigidity and electrical contact are assured. Alternates of the preferred embodiment are disclosed. An improved method is also disclosed for manufacturing convenience in a cost effective manner.

14 Claims, 5 Drawing Sheets

FILTERED COAXIAL ASSEMBLY

FIELD OF THE INVENTION

The present invention relates to a coaxial assembly for electrical apparatus, and more particularly, to a filtered coaxial assembly and a method of construction therefor.

BACKGROUND OF THE INVENTION

In communication and electronic equipment, such as those which employ coaxial assemblies, electronic filters are used extensively to attenuate certain signals in transmission lines by shunting those signals to ground. The filters are for EMI/RFI suppression and may be of the distributed or lumped element type. These filters have a molded ceramic construction and have a lossy ferrite compound dispersed therein, hence are somewhat fragile. An example of such a filter is illustrated and described in U.S. Pat. No. Re. 29,258 reissued on June 7, 1977 and assigned to the assignee of the present invention.

In the prior art of coaxial assemblies, as exemplified by U.S. Pat. No. 4,206,963 issued on June 10, 1980 and assigned to the assignee of the present invention, a ceramic filter sleeve is press-fitted concentrically over an inner pin member. In the press-fitting operation it is sometimes difficult, if not expensive, to control the respective dimensions of the inner diameter of the filter sleeve and the outer diameter of the pin member to relatively close tolerances; and if not closely controlled, the parts may be slightly damaged during their assembly. Accordingly, under those conditions, it is sometimes difficult to obtain a good mechanical rigidity and electrical contact between the filter sleeve and its adjacent components.

While filter sleeves have been soldered to terminals, per se, nevertheless soldering operations have heretofore not been used with respect to filter sleeves used in coaxial assemblies for electronic equipment. Generally such connectors have relied on mechanical means to hold the assemblies together.

SUMMARY OF THE INVENTION

Accordingly, it is an object of the present invention to alleviate the disadvantages and deficiencies of the prior art by providing a soldered filter sleeve construction for a coaxial assembly, together with an improved soldering method.

It is a further object to obtain a solid mechanical rigidity and an excellent electrical contact between the filter sleeve and the respective inner and outer structural members in the coaxial assembly, thereby providing a rugged and reliable assembly, conveniently, and in a cost effective manner.

In accordance with the teachings of the present invention, there is herein illustrated and described, a coaxial cable assembly having an inner member, an outer member, and a filter sleeve disposed concentrically between the inner and outer members. The filter sleeve has an axial length and further has respective first and second ends. The filter sleeve and each of the members have a radial gap therebetween. The radial gaps extend substantially along the axial length of the filter sleeve. Solder is disposed substantially throughout each of the radial gaps, thereby providing for both solid mechanical rigidity and excellent electrical contact between the filter sleeve and each of the members.

Preferably, a potting compound is disposed at each end of the filter sleeve, subsequent to the soldering operation. The potting compound comprises an epoxy disposed radially of the inner member and the outer member at each end of the filter sleeve. The inner member may comprise a contact terminal, and the outer member may comprise a ground shell.

In a preferred embodiment, the ground shell has respective first and second ends, and the contact terminal extends axially beyond the filter sleeve and beyond the first end of the ground shell. An insulating mounting collar is disposed radially between the ground shell and the contact terminal, axially of the second end of the filter sleeve. In addition, a dielectric member is disposed within the ground shell and axially beyond the insulating mounting collar. The collar and cooperating dielectric member have respective annular shoulders nested within one another, thereby increasing the leakage path to ground.

In a first alternate embodiment, the inner member comprises a tubular shell providing a first ground. A contact socket is disposed concentrically within the tubular shell, and the outer member comprises a second ground shell.

In a second alternate embodiment, a threaded collar is carried by the outer member, such that the combination comprises an adapter assembly. A separate cylindrical shell is provided; and the shell has a flange, such that the shell may be disposed within an aperture formed in a panel. A gasket is disposed against the panel oppositely of the flange on the shell, and threads are formed externally on the shell. A nut is carried by the external threads on the shell for retaining the shell on the panel, and the shell has internal threads formed therein for receiving the threaded collar on the adapter assembly.

In a third alternate embodiment, a tubular housing is disposed concentrically around the outer member, and a second filter sleeve is disposed concentrically between the tubular housing and the outer member and has respective radial gaps therebetween. This second filter sleeve has respective axial ends, and a radial gap is formed between the second filter sleeve and the tubular housing, and between the second filter sleeve and the outer member. Solder is disposed substantially within the respective radial gaps, thereby providing for mechanical rigidity and electrical contact between the second filter sleeve and the tubular housing, and between the second filter sleeve and the outer member, respectively. Preferably, a potting compound is disposed at each end of the second filter sleeve and radially between the tubular housing and the outer member.

In a fourth alternate embodiment, an isolated grounding system between the panel ground and the matable portion of the connector is provided to prevent feedback of unwanted signals. The ground shell is comprised of two sections, isolated from each other by a dielectric material.

In accordance with the further teachings of the present invention, there is herein illustrated and described, an improved method for securing a filter sleeve to the respective inner and outer members of a coaxial cable assembly and assuring mechanical rigidity and electrical contact therebetween. This method includes the step of fixturing the inner member concentrically within the filter sleeve, such that a first radial gap exists between the inner member and the filter sleeve substantially along the axial length of the filter sleeve and from one end of the filter sleeve to the other end thereof. The filter sleeve and the inner member are disposed in a substantially vertical orientation. A first ring of solder is disposed on the upper axial end of the filter sleeve and about the inner member. Heat is applied to melt the first solder ring so that the solder flows down into the first radial gap between the inner member and the filter sleeve and substantially fills the first radial gap, thereby forming a subassembly of the filter sleeve secured to the inner member. This subassembly is fixtured concentrically within the outer member, such that a second radial gap exists between the filter sleeve and the outer member along at least a portion of the axial length of the filter sleeve. The subassembly and the outer member are disposed in a substantially vertical orientation. A second ring of solder is disposed above the said axial length portion of the sleeve. Heat is applied to melt the second solder ring, such that the solder flows down into the second radial gap between the filter sleeve and the outer member and substantially fills the second radial gap.

Preferably, the outer member has a radially-inwardly projecting annular boss cooperating with the outer diameter of the filter sleeve to form the second radial gap, and the second solder ring is placed on an annular ledge formed by the inwardly-projecting radial boss. Moreover, the first solder ring melts at a higher temperature than the second solder ring.

These and other objects of the present invention will become apparent by way of example from a reading of the following specification, taken in conjunction with the enclosed drawings.

DETAILED DESCRIPTION OF THE PREFERRED EMBODIMENTS

Figure 1:
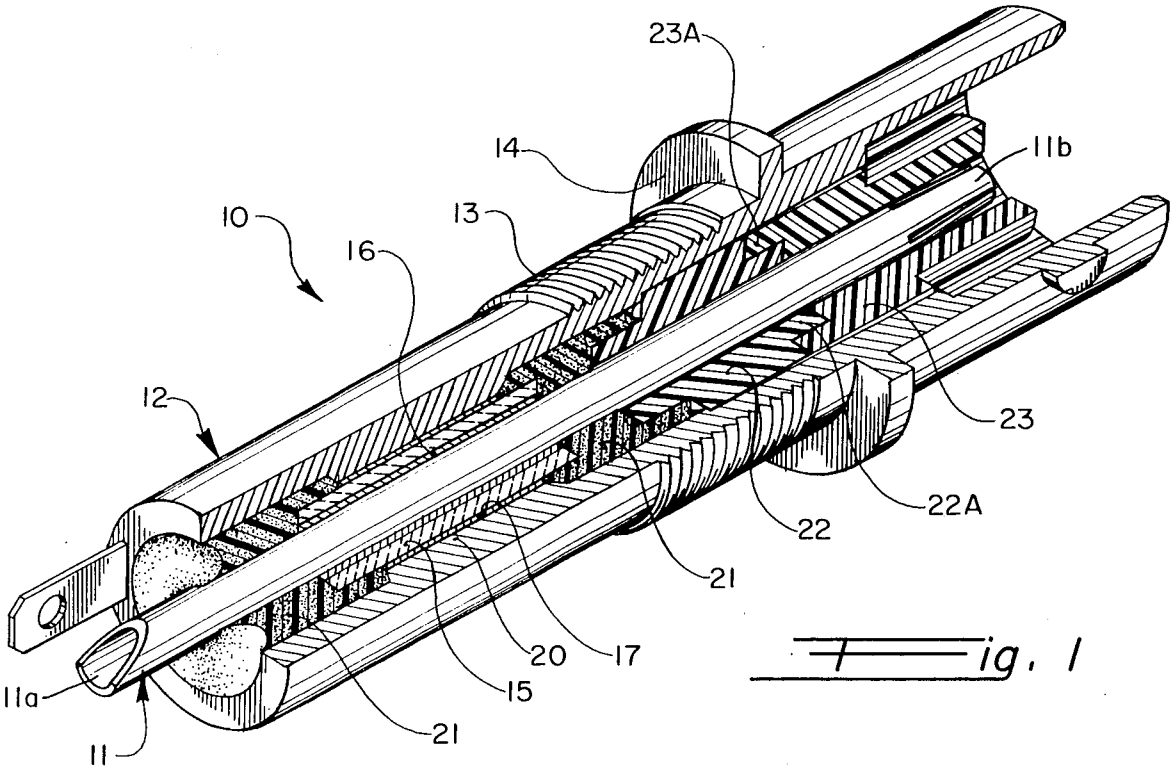
FIG. 1 is a half-section isometric view, with parts broken away and sectioned, of a preferred embodiment of a coaxial assembly incorporating the teachings of the present invention.

With reference to FIGS. 1-6, constituting a preferred embodiment of the present invention, there is illustrated a coaxial assembly 10 having an inner member 11 and an outer member 12 arranged concentrically thereof. The inner member constitutes a cylindrical contact terminal 11, and the outer member constitutes a cylindrical ground shell 12. The ground shell 12 has external threads 13 and a radially-projecting flange 14, thereby facilitating the securing of the coaxial assembly within an electronic apparatus (not shown herein).

Figure 2:
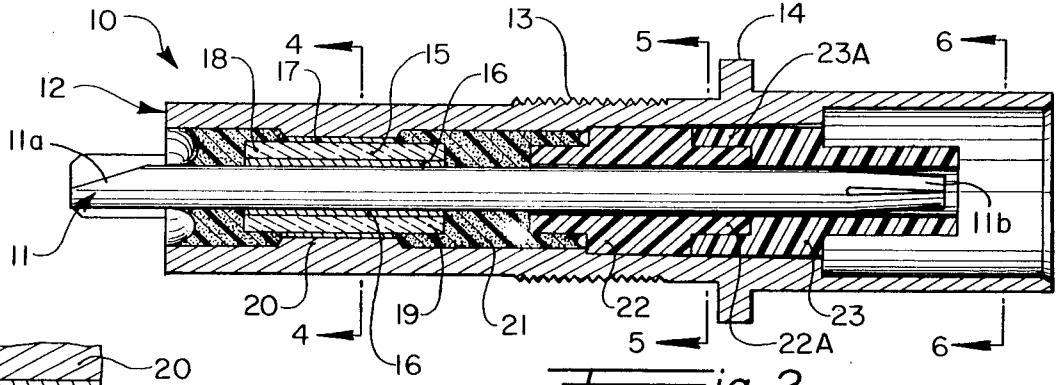
FIG. 2 is a longitudinal sectional view thereof.
Figure 3:
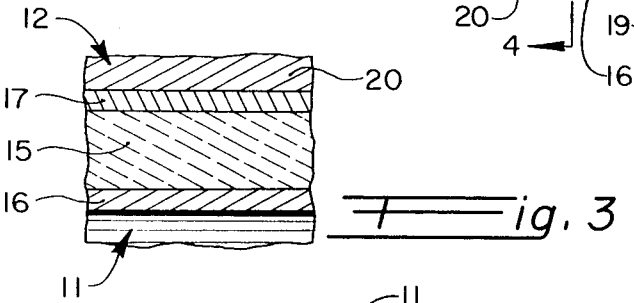
FIG. 3 is a portion of FIG. 2, drawn to an enlarged scale, and showing the respective solder disposed, first, between the inner member and the filter sleeve and, second, between the filter sleeve and the outer member.
Figure 4:
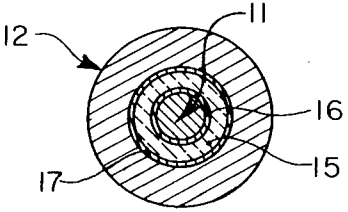
FIG. 4 is a cross-sectional view, taken along the lines 4—4 of FIG. 2, and showing the filter sleeve disposed concentrically between respective inner and outer members and soldered thereto.
Figure 5:
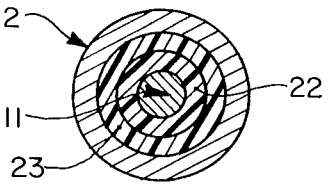
FIG. 5 is a further cross-sectional view, taken along the lines 5—5 of FIG. 2.
Figure 6:
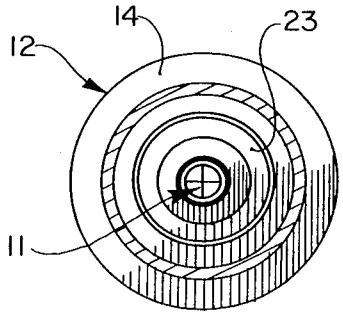
FIG. 6 is a still further cross-sectional view, taken along the lines 6—6 of FIG. 2.

As best seen in FIGS. 1 and 2, filter sleeve 15 is disposed concentrically between the inner contact terminal 11 and the outer ground shell 12. Terminal 11 is shown as a screw machined part having a solder cup **11*a* at one end and a socket contact 11*b* at the other. Socket contact 11*b* preferably has a plurality of spring fingers formed by cutting a plurality of slots into the drilled out portion of the rod. The terminal is then subjected to heat treatment, as known in the art, to provide permanent resiliency to the spring fingers. In the embodiments shown, solder contact 11*b* is the inner contact of a biaxial connector assembly and is designed to mate with another coaxial connector, such as a BNC (bayonet-locking coupling) connector. The filter sleeve 15 is soldered to the inner contact terminal 11, as at 16, and is soldered to the outer ground shell 12, as at 17, as shown more clearly in FIGS. 3 and 4. Referring again to FIGS. 1 and 2, solder 16, constituting a cylinder shell, extends substantially from one axial end 18 to the other axial end 19 of the filter sleeve 16. The outer ground shell 12 has an inner projecting annular boss 20 disposed radially of a portion of the axial length of the filter sleeve 15, and the solder 17 is disposed substantially along the axial length of the boss 20**.

Subsequent to the soldering operations (as hereinafter described in detail) a plotting compound 21 is placed at each end of the filter sleeve 15 and radially between the inner contact terminal 11 and the outer ground shell 12, as shown more clearly in FIGS. 1 and 2. Preferably, the potting compound comprises a suitable epoxy.

With this arrangement, good mechanical rigidity and electrical contact are achieved between the filter sleeve 15 and the contact terminal 11 and ground shell 12, respectively, thereby resulting in an improved structure, conveniently, and with a minimum of manufacturing cost.

Additionally, a dielectric collar 22 is inserted rearwardly into the ground shell 12 while the epoxy potting compound 21 is being cured, and thereafter, a dielectric member 23 is inserted into the ground shell and is retained therein, preferably by a suitable staking operation. Both the dielectric collar 22 and dielectric member 23 are apertured (as shown in FIGS. 1, 2, 5 and 6) to receive the contact terminal 11. For electrical reasons, the dielectric collar 22 and the dielectric member 23 have annular shoulders 22A and 23A, respectively, which nest with respect to each other to increase the leakage path between the inner contact terminal 11 and the outer ground shell 12, as shown more clearly in FIGS. 1 and 2.

Figures 7, 8, 9, 10, 11, 12:
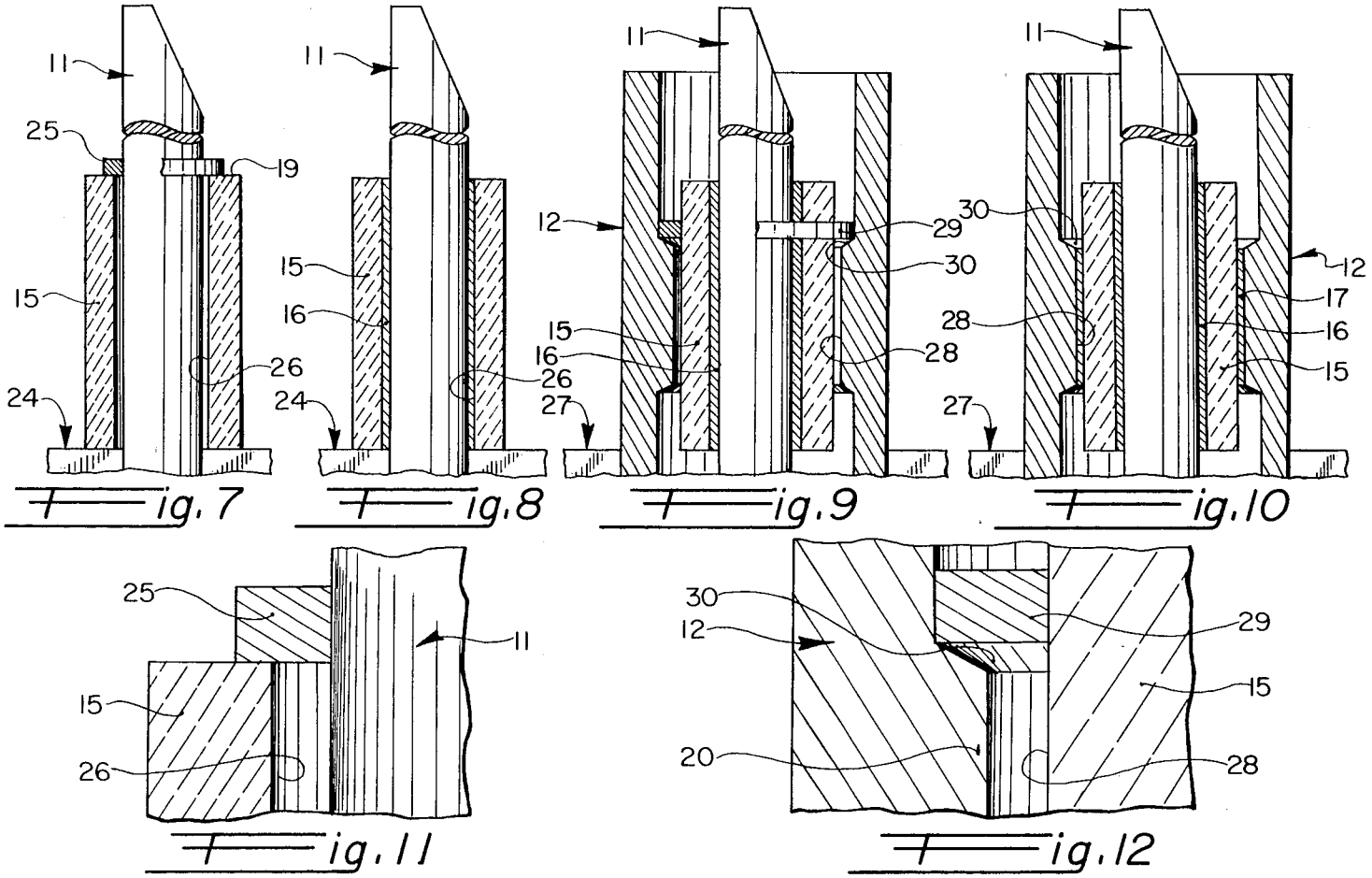
FIGS. 7-10, respectively, illustrate the sequence of steps comprising the improved method of the present invention.
FIG. 11 is a portion of FIG. 7, drawn to an enlarged scale, and illustrating the radial gap between an inner member and the filter sleeve.
FIG. 12 is a portion of FIG. 9, drawn to an enlarged scale, and illustrating the radial gap between the filter sleeve and an outer member.

With reference to FIGS. 7–10, the schematic sequence of operations of the improved method of the present invention is illustrated. The filter sleeve 15 is inserted over the contact terminal 11 in a suitable fixture, denoted as at 24 and preferably in a vertical orientation as shown in FIG. 7. A first ring 25 of solder is placed on the upper axial end 19 of the filter sleeve 15, and is disposed concentrically of the contact terminal 11. Preferably, and as shown more clearly in FIG. 11, the contact terminal 11 and the inner diameter of the filter sleeve 15 have a first radial gap 26 therebetween which runs substantially along the axial length of the filter sleeve 15.

Thereafter, and as illustrated in FIG. 8, heat is applied to melt the first ring 25 of solder, such that the hot liquid solder 16 flows downwardly, essentially by the force of gravity, between the contact terminal 11 and the filter sleeve 15. The solder substantially fills the first radial gap 26, thereby rigidly securing the filter sleeve 15 to the contact terminal 11 and assuring excellent electrical contact therebetween.

The subassembly of the filter sleeve 15 and contact terminal 11 is then placed concentrically within the outer ground shell 12, again in a substantially vertical orientation and in a suitable fixture 27, as shown more clearly in FIG. 9. A second radial gap 28 is provided between the outer diameter of the filter sleeve 15 and the outer ground shell 2, and more particularly the boss portion 20 thereof, as shown more clearly in FIG. 12. A second ring 29 of solder is placed radially between the filter sleeve 15 and the ground shell 12, such that the second ring 29 of solder rests upon an annular ledge 30 formed by the boss portion 20 of the ground shell 12.

Thereafter, and as illustrated in FIG. 10, heat is applied to melt the second ring 29 of solder, such that the hot liquid solder 17 flows downwardly, essentially by the force of gravity, between the filter sleeve 15 and the boss portion 20 of the ground shell 12. The solder substantially fills the second radial gap 28, thereby securing the ground shell 12 to the subassembly of the filter sleeve 15 and the contact terminal 11.

Preferably, the second ring 29 of solder melts at a lower temperature than the first ring 25 of solder so that the solder 16 between the contact terminal 11 and the filter sleeve 15 (resulting from the first ring 25 of solder) will not melt and flow out of the subassembly of the contact terminal 11 and the filter sleeve 15 during the second soldering operation when the filter sleeve 15 is soldered to the ground shell 12.

The heat (at the two different temperatures) may be applied in any suitable manner, such as in an oven; and the soldering operation may be conducted in a batch or in a conveyorized system, as will be appreciated by one skilled in the art.

Figures 13, 14, 15, 16:
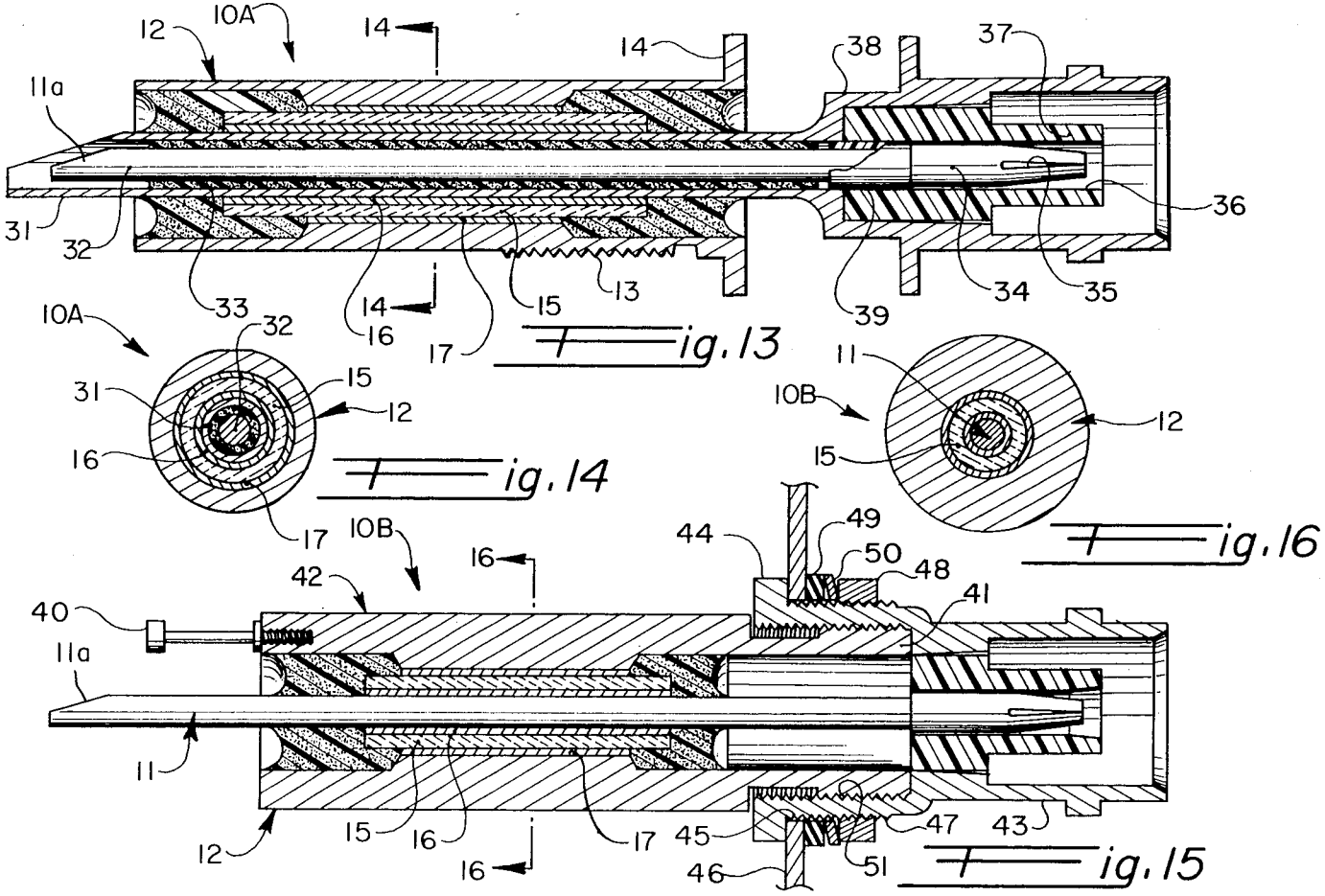
FIG. 13 is a longitudinal section, corresponding to that of FIG. 2, but illustrating a first alternate embodiment of the present invention.
FIG. 14 is a cross-sectional view thereof, taken along the lines 14—14 of FIG. 13.
FIG. 15 is a longitudinal section, corresponding to that of FIG. 2, but illustrating a second alternate embodiment of the present invention.
FIG. 16 is a cross-sectional view thereof, taken along the lines 16—16 of FIG. 15.

With reference to FIGS. 13 and 14, a first alternate embodiment 10A of the invention is illustrated (wherein the same numbers are used to denote the same parts as in the preferred embodiment of FIGS. 1–6). In this embodiment of filter isolates the circuit ground against the ground of an apparatus. Here, the inner member comprises a tubular shell 31 which provides a first or circuit ground. Shell 12 is mountable to a chassis panel (not shown) such that flange 14 is grounded to the panel to provide a ground path to the apparatus.

Electrical terminal 32 having a contact socket 34 at one end and a solder cup **11*a* at the other is disposed concentrically within the tubular shell 31, and an epoxy putting compound 33 is disposed betwen the tubular shell 31 and the electrical terminal 32. The electrical terminal 32 comprises a solid rod (as shown in section in FIG. 14) which has one end thereof press-fitted within a cylindrical contact member 34. This cylindrical contact member 34 is tapered forwardly thereof and is provided with a plurality of circumferentially spaced longitudinal slots, one of which is shown as at 35 to form a plurality of spring fingers. Preferably the contact member 34 is heat treated by means known in the art to provide resiliency to the spring fingers. The tapered slotted forward portion of the contact member 34 is received within the bore 36 of a dielectric insert 37. This dielectric insert 37 is staked within an enlarged cylindrical shell 38 formed integrally with the tubular shell 31. An insulated bushing 39 is carried by the rod portion of the electrical terminal 32. This insulated bushing 39 is disposed between the dielectric member 37 and the rod portion of the electric terminal 32, and is lodged against the shoulder formed by the cylindrical contact socket member 34 carried by the terminal 32**.

In this first alternate embodiment 10A of FIGS. 13 and 14, the filter sleeve 15 is soldered to the tubular ground shell 31 and to the outer ground shell 12, using substantially the same method of process illustrated schematically in the sequence drawings of FIGS. 7–10 herein.

With reference to FIGS. 15 and 16, a second alternate embodiment 10B of the invention is illustrated (wherein the same numbers are again used to denote the same parts as in the preferred embodiment of FIGS. 1–6). Here, the outer ground shell 12 is shown with a ground pin 40 at one end thereof for connection to grounding means (not shown) for providing a grounding path for shell 12. The outer ground shell 12 further has an externally-threaded collar 41 at the other end thereof, thereby forming an adapter assembly denoted generally as at 42. This adapter assembly 42 cooperated with a separate cylindrical shell 43 having a flange 44. The shell 43 is received within an aperture 46 formed in a panel 46. External threads 47 are formed on the shell 43 for receiving a nut 48. The nut 48 bears against a gasket 49 and a lock washer 50, thereby securing the shell 43 to the panel 46. Internal threads 51 are formed within the shell 43 for receiving the externally-threaded collar 41 of the adapter assembly 42, thereby removably securing the adapter assembly 42 to the shell 43.

Figure 18:
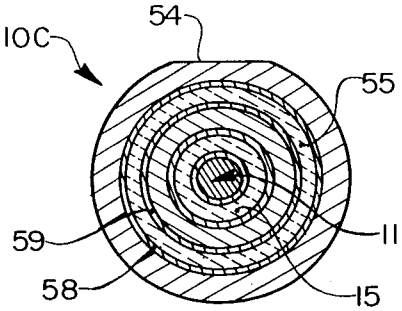
FIG. 18 is a cross-sectional view thereof, taken along the lines 18—18 of FIG. 17.
Figure 17:
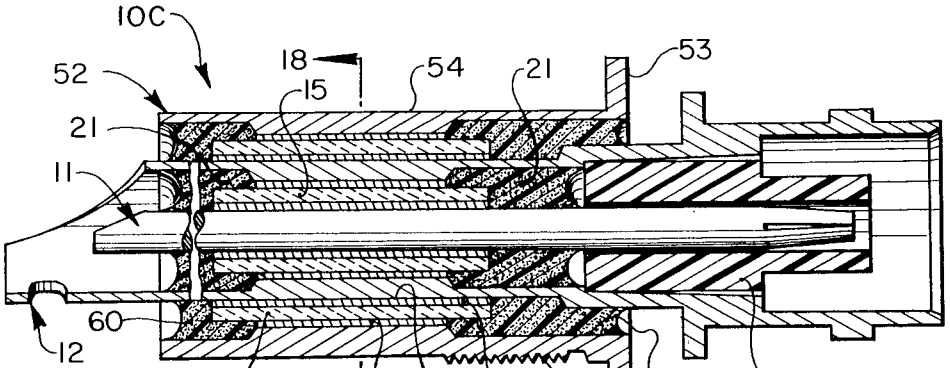
FIG. 17 is a longitudinal section, corresponding to that of FIG. 2, but illustrating a third alternate embodiment of the present invention.

With reference to FIGS. 17 and 18, a third alternate embodiment 10C of the invention is illustrated (wherein the same numbers are again used to denote the same parts as in the preferred embodiment of FIGS. 1–6). In this embodiment for decoupling circuits, a primary filter member is used to filter interference from signal conductor to ground and a second filter member is used as protection to conduct any excess interference beyond the capacity of the primary filter to a second ground. Here, a tubular housing 52 is disposed concentrically around the outer ground shell 12. This tubular housing 52 is provided with a flange 53 and preferably is truncated to provide a flat surface, as at 54 in FIG. 18. The flat surface is primarily used as an "antirotation" means when the connector is mounted in a correspondingly configures aperture in a panel and secured with a nut or similar device to the panel. A second filter sleeve 55 is disposed concentrically between the tubular housing 52 and the ground shell 12. A radial gap 56 is formed between the second filter sleeve 55 and the tubular housing 52, and a radial gap 57 is formed between the second filter sleeve and the ground shell 12. Solder 58 and 59 is disposed substantially within the respective radial gaps 56 and 57, respectively, thereby providing for mechanical rigidity and electrical contact between the second filter sleeve 55 and the tubular housing 52, and between the second filter sleeve 55 and the ground shell 12, respectively. Preferably, an epoxy potting compound, 60 and 61, respectively, is disposed at each end of the second filter sleeve 55 and radially between the tubular housing 52 and the ground shell 12. Preferably, the tubular housing 52 is provided with external threads 62.

Figure 20:
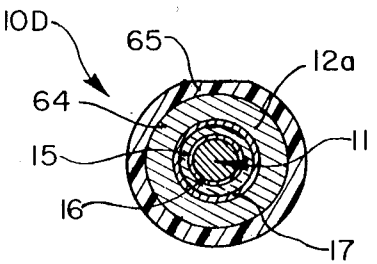
FIG. 20 is a cross-sectional view thereof, taken along the lines 20—20 of FIG. 19.
Figure 19:
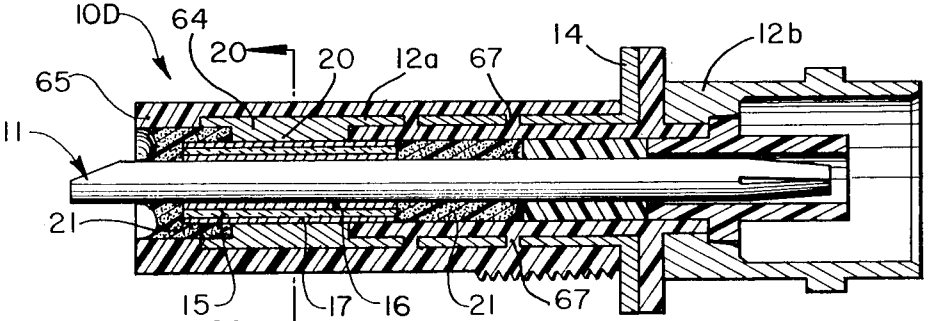
FIG. 19 is a longitudinal section, corresponding to that of FIG. 2, but illustrating a fourth alternate embodiment of the present invention.

With reference to FIGS. 19 and 20, a fourth alternate embodiment 10D of the invention is illustrated (wherein the same members are again used to denote the same parts as in the preferred embodiment of FIGS. 1–6).

This embodiment is directed to a filtered coaxial connector using an isolated grounding system to prevent feedback of unwanted signals. The outer shell of the BNC connector portion **12*b* is isolated from the ground of the panel or box (not shown) to which the filtered coaxial connector 100 is mounted. Shell 12 of this embodiment is comprised of first and second portions 12*a*, 12*b*. First portion 12*a* includes a cylindrical body member 64 with a radially extending flange portion 14 inwardly projecting boss portion 20, and a plurality of apertures 67 therein. A layer of dielectric material 65 is disposed on portions of the outer and inner walls of body member 64, the inner and outer dielectric layers being joined through apertures 67, as best seen in FIG. 19. Dielectric material 65 also extends into a portion of shell 12*b* and along the surface of flange 14 between shell portions 12*a* and 12*b* to electrically insulate ground shell portion 12*a* from shell portion 12*b*** and provide an isolated ground path for the filtered connector assembly.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A coaxial cable assembly comprising:

a tubular shell inner member providing a first ground;

a contact socket disposed concentrically within said tubular shell;

an outer member comprising a second ground shell;

a filter sleeve disposed concentrically between the inner and outer members, the filter sleeve having an axial length and further having respective first and second ends, the filter sleeve and each of the members having a radial gap therebetween, the radial gap extending substantially along the axial length of the filter sleeve; and solder disposed substantially throughout each of the radial gaps, thereby providing for both mechanical rigidity and electrical contact between the filter sleeve and each of the members.

2. The assembly of claim 1 further including a threaded collar carried by the outer member, such that the assembly comprises an adapter assembly, a shell having a flange, whereby the shell may be disposed within an aperture formed in a panel, a gasket against the panel oppositely of the flange on the shell, threads formed externally on the shell, a nut carried by the external threads on the shell for retaining the shell on the panel, and the shell having internal threads formed therein for receiving the threaded collar on the adapter assembly.

3. The asembly of claim 1 further including a potting compound disposed at each end of the filter sleeve.

4. The assembly of claim 3 wherein the potting compound comprises an epoxy material disposed radially of the inner member and the outer member at each end of the filter sleeve.

5. A coaxial cable assembly comprising:

an inner contact terminal member;

an outer ground shell member;

a filter sleeve disposed concentrically between the inner and outer members, such that the contact terminal extends axially beyond the first end of the filter sleeve and beyond the ground shell, the filter sleeve having an axial length and further having respective first and second ends, the filter sleeve and each of the members having a radial gap therebetween, the radial gap extending substantially along the axial length of the filter sleeve;

an insulating mounting collar disposed radially between the ground shell and the contact terminal axially of the second end of the filter sleeve;

a dielectric member disposed within the ground shell axially beyond the insulating mounting collar, the collar and the dielectric member having respective annular shoulders which are nested with respect to each other, thereby increasing the leakage path to ground; and solder disposed substantially throughout each of the radial gaps, thereby providing for both mechanical rigidity and electric contact between the filter sleeve and each of the members.

6. The assembly of claim 5 further including a threaded collar carried by the outer member, such that the assembly comprises an adapter assembly, a shell having a flange, whereby the shell may be disposed within an aperture formed in a panel, a gasket against the panel oppositely of the flange on the shell, threads formed externally on the shell, a nut carried by the external threads on the shell for retaining the shell on the panel, and the shell having internal threads formed therein for receiving the threaded collar on the adapter assembly.

7. The assembly of claim 5 further including a potting compound disposed at each end of the filter sleeve.

8. The assembly of claim 7 wherein the potting compound comprises an epoxy material disposed radially of the inner member and the outer member at each end of the filter sleeve.

9. A coaxial cable assembly comprising:

an inner member;

a cylindrical ground shell outer member having first and second portions;

a dielectric member for insulating said first and second portions from each other to provide isolated ground paths for each of said portions;

a filter sleeve disposed concentrically between the inner and outer members, the filter sleeve having an axial length and further having respective first and second ends, the filter sleeve and each of the members having a radial gap therebetween, the radial gap extending substantially along the axial length of the filter sleeve; and solder disposed substantially throughout each of the radial gaps, thereby providing for both mechanical rigidity and electrical contact between the filter sleeve and each of the members.

10. The assembly of claim 9 further including a potting compound disposed at each end of the filter sleeve.

11. The assembly of claim 10, wherein the potting compound comprises an epoxy material disposed radially of the inner member and the outer member at each end of the filter sleeve.

12. A coaxial cable assembly comprising:

an inner member;

an outer member;

a first filter sleeve disposed concentrically between the inner and outer members, the first filter sleeve having an axial length and further having respective first and second ends, the first filter sleeve and each of the members having a radial gap therebetween, the radial gap extending substantially along the axial length of the first filter sleeve;

a tubular housing disposed concentrically around the outer member;

a second filter sleeve disposed concentrically between the tubular housing and the outer member, the second filter sleeve and the tubular housing having a radial gap therebetween, the second filter sleeve and the outer member having a radial gap therebetween, the second filter sleeve having respective axial ends; and solder disposed substantially within the respective radial gaps, thereby providing for mechanical rigidity and electrical contact, between the first filter sleeve and each of the members and between the second filter sleeve and the tubular housing, and between the second filter sleeve and the outer member, respectively.

13. The assembly of claim 12 further including a potting compound disposed at each end of the second filter sleeve and radially between the tubular housing and the outer member.

14. The assembly of claim 13, wherein the potting compound comprises an epoxy material disposed radially of the inner member and the outer member at each end of the filter sleeve.

* * * * *